US011110707B2

(12) United States Patent
Mizuno

(10) Patent No.: US 11,110,707 B2
(45) Date of Patent: Sep. 7, 2021

(54) LIQUID EJECTION HEAD

(71) Applicant: Brother Kogyo Kabushiki Kaisha, Nagoya (JP)

(72) Inventor: Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/835,513

(22) Filed: Mar. 31, 2020

(65) Prior Publication Data

US 2020/0316939 A1 Oct. 8, 2020

(30) Foreign Application Priority Data

Apr. 4, 2019 (JP) ..... JP2019-072136

(51) Int. Cl.
*B41J 2/14* (2006.01)
*B41J 2/045* (2006.01)

(52) U.S. Cl.
CPC ..... *B41J 2/1433* (2013.01); *B41J 2/04501* (2013.01); *B41J 2/14032* (2013.01)

(58) Field of Classification Search
CPC ..... B41J 2/14233; B41J 2/1433; B41J 2002/14419; B41J 2202/12; B41J 2002/14241; B41J 2/04501; B41J 2/14032
USPC ..... 347/20, 54, 68, 84, 85
See application file for complete search history.

(56) References Cited

U.S. PATENT DOCUMENTS

| | | | | |
|---|---|---|---|---|
| 7,971,981 | B2 | 7/2011 | Nagashima et al. | |
| 8,870,353 | B2 * | 10/2014 | Watanabe | B41J 2/14274 347/70 |
| 10,022,967 | B2 * | 7/2018 | Mizuno | B41J 2/04505 |
| 10,549,539 | B2 * | 2/2020 | Katayama | B41J 2/14209 |
| 2008/0238980 | A1 | 10/2008 | Nagashima et al. | |
| 2012/0176450 | A1 | 7/2012 | Akahane et al. | |

FOREIGN PATENT DOCUMENTS

| | | | |
|---|---|---|---|
| JP | 2009-241316 | A | 10/2009 |
| JP | 4855992 | B2 | 1/2012 |
| JP | 2015-134507 | A | 7/2015 |
| JP | 6067521 | B2 | 1/2017 |

* cited by examiner

*Primary Examiner* — An H Do
(74) *Attorney, Agent, or Firm* — Banner & Witcoff, Ltd.

(57) ABSTRACT

A liquid ejection head includes first individual channels arranged in a first direction, a first common channel extending in the first direction and communicating with the first individual channels, and a second common channel located below the first common channel and extending in the first direction. The second common channel communicates with the first individual channels. Each of the first individual channels includes one of first nozzles, and one of first pressure chambers that communicate with the respective first nozzles and are located above the first nozzles. The first common channel and the second common channel overlap, in a vertical direction, with each other at a position above the first pressure chambers. The first common channel overlaps, in the vertical direction, with the first pressure chambers. The second common channel does not overlap, in the vertical direction, with the first pressure chambers.

15 Claims, 6 Drawing Sheets

LIQUID EJECTION HEAD

CROSS-REFERENCE TO RELATED APPLICATION

This application claims priority from Japanese Patent Application No. 2019-072136 filed on Apr. 4, 2019, the content of which is incorporated herein by reference in its entirety.

TECHNICAL FIELD

Aspects of the disclosure relate to a liquid ejection head including a plurality of individual channels, a first common channel, and a second common channel.

BACKGROUND

A known liquid ejection head includes a plurality of individual channels arranged in a longitudinal direction of the head (e.g., a first direction). The liquid ejection head further includes common channels, e.g., a manifold and a circulation channel, that communicate with the respective individual channels. Each of the individual channels includes a nozzle and a pressure-generating chamber (pressure chamber) located above the nozzle.

SUMMARY

In the known liquid ejection head, the manifold, an array of the pressure-generating chambers (pressure chambers), and the circulation channel are arranged in a width direction of the head (e.g., a second direction). In this configuration, if volumes of the common channels are increased for the purpose of, for example, reducing pressure losses, the liquid ejection head may increase its size in the second direction.

Aspects of the disclosure provide a liquid ejection head that may increase volumes of common channels while preventing or reducing an increase in size of the liquid ejection head in a second direction.

According to one or more aspects of the disclosure, a liquid ejection head comprises a plurality of first individual channels, a first common channel, and a second common channel The first individual channels are arranged in a first direction perpendicular to a vertical direction. The first common channel extends in the first direction. The first common channel communicates with the first individual channels. The second common channel is located below the first common channel and extends in the first direction. The second common channel communicates with the first individual channels. Each of the first individual channels includes one of first nozzles, and one of first pressure chambers that communicate with the respective first nozzles and are located above the first nozzles. The first common channel and the second common channel overlap, in the vertical direction, with each other at a position above the first pressure chambers. The first common channel overlaps, in the vertical direction, with the first pressure chambers. The second common channel does not overlap, in the vertical direction, with the first pressure chambers.

According to aspects of the disclosure, the liquid ejection head may increase volumes of the common channels while preventing or reducing an increase in size of the liquid ejection head in the second direction.

DETAILED DESCRIPTION

<First illustrative Embodiment>

Figure 1:
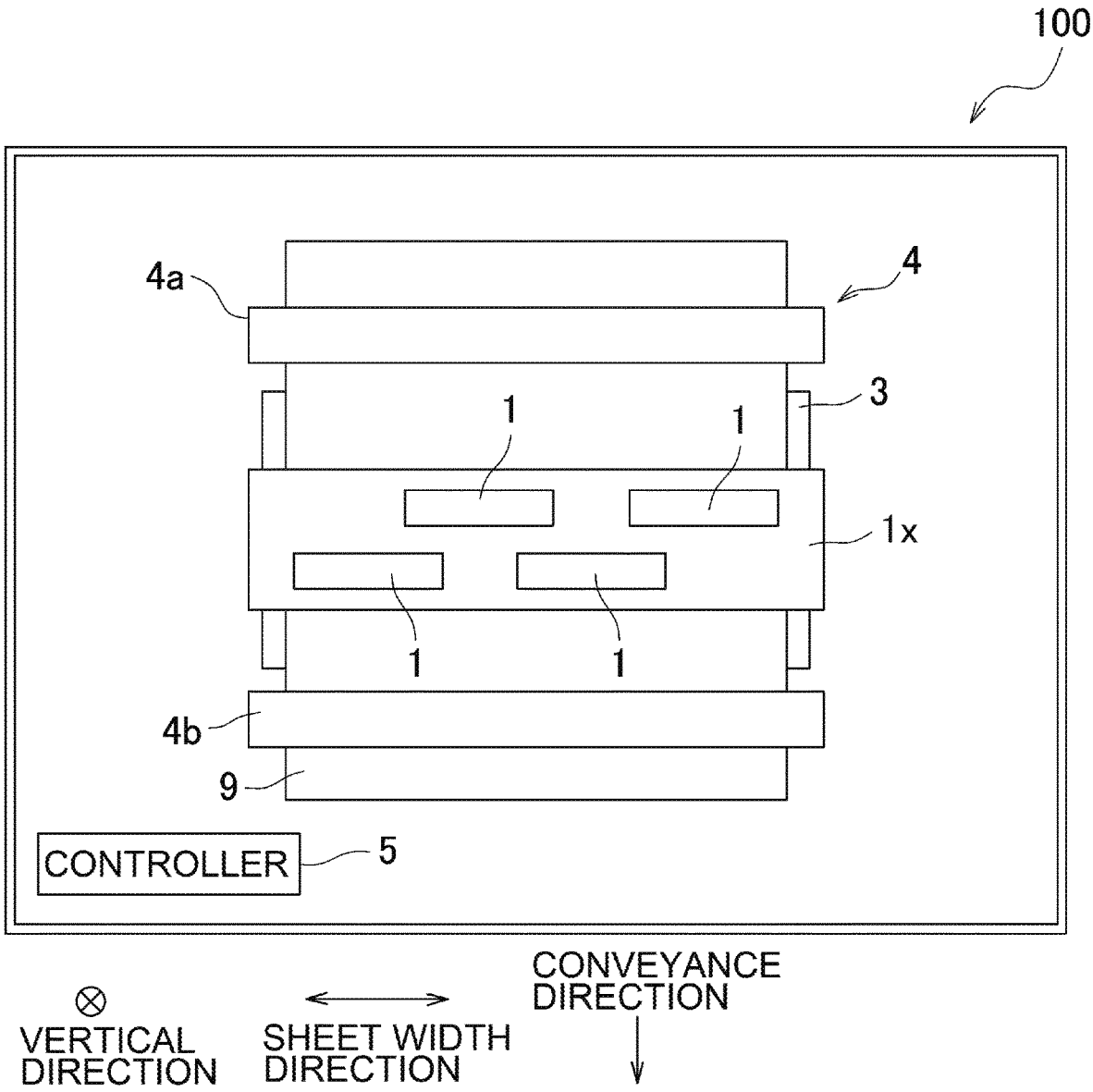
FIG. 1 is a plan view of a printer including a head in a first illustrative embodiment according to aspects of the disclosure.

Referring to FIG. 1, a configuration of a printer 100 including a head 1 according to a first illustrative embodiment of the disclosure will be described below.

The printer 100 includes a head unit 1*x* that includes four heads 1, a platen 3, a conveyance mechanism 4, and a controller 5.

The platen 3 has an upper surface configured to support a sheet 9.

Figure 4:
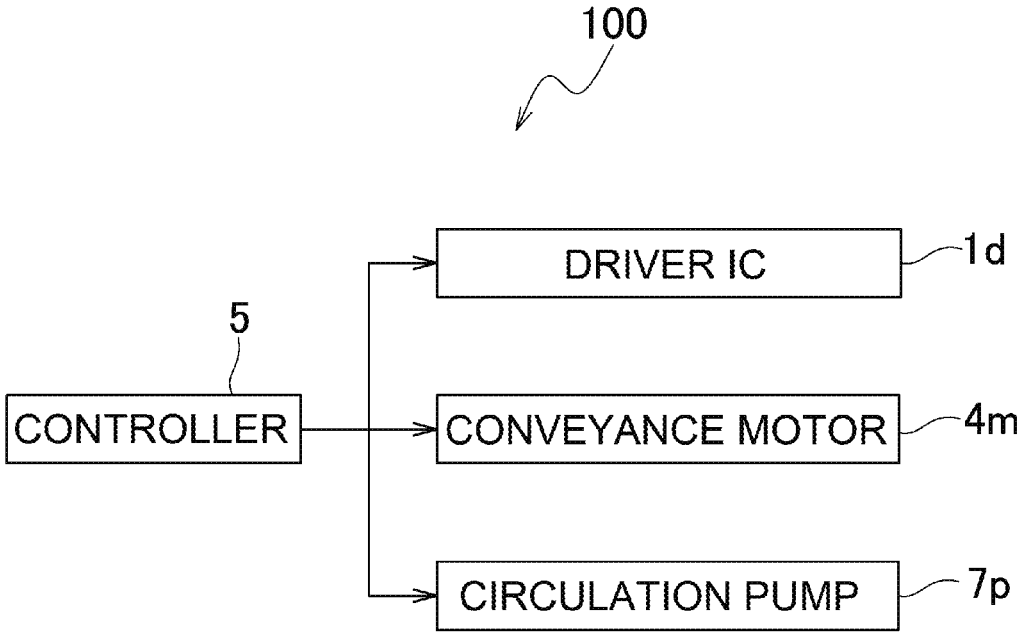
FIG. 4 is a block diagram illustrating an electrical configuration of the printer of FIG. 1.

The conveyance mechanism 4 has two roller pairs 4*a* and 4*b* sandwiching the platen 3 in a conveyance direction. A conveyance motor 4*m* (refer to FIG. 4) is driven under the control of the controller 5. This may cause the roller pairs 4*a* and 4*b* to rotate while pinching the sheet 9, thereby conveying the sheet 9 in the conveyance direction.

The head unit 1*x* is longer in a sheet width direction, which is perpendicular to both of the conveyance direction and a vertical direction. The head unit 1*x* is of a line type, in which the head unit 1*x* at a fixed position ejects ink to the sheet 9 through nozzles 11 (refer to FIGS. 2 and 3). Each of the four heads 1 is longer in the sheet width direction. The four heads 1 are staggered in the sheet width direction.

The controller 5 includes a read only memory (ROM), a random access memory (RAM), and an application specific integrated circuit (ASIC). The ASIC performs processes, such as a recording process, in accordance with programs stored in the ROM. In the recording process, the controller 5 controls a driver IC 1*d* (refer to FIG. 4) in each head 1 and the conveyance motor 4*m* (refer to FIG. 4) in accordance with a recording command (including image data) input from an external device, such as a personal computer (PC), to record an image on the sheet 9.

Figure 2:
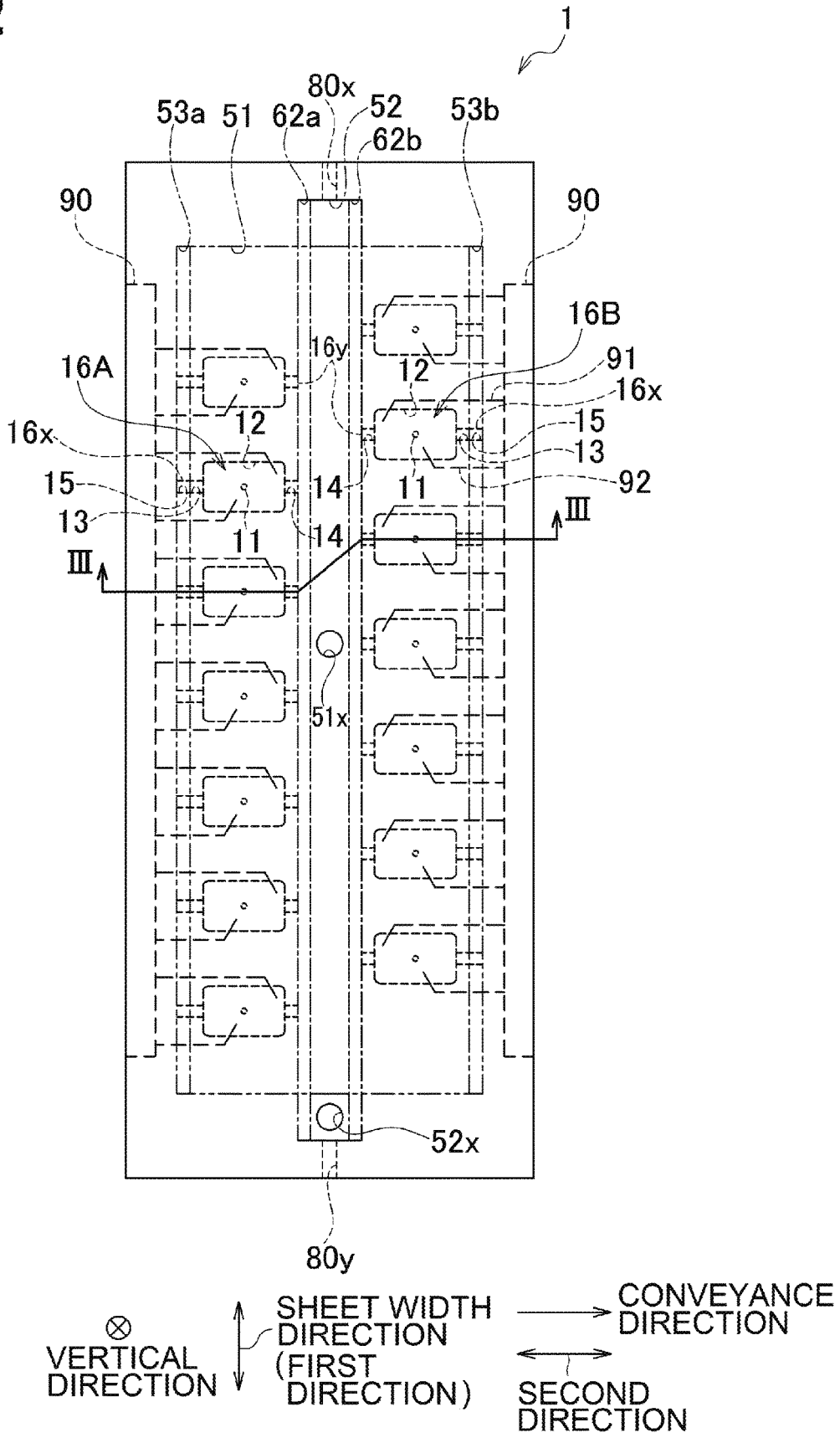
FIG. 2 is a plan view of the head of the printer of FIG. 1.
Figure 3:
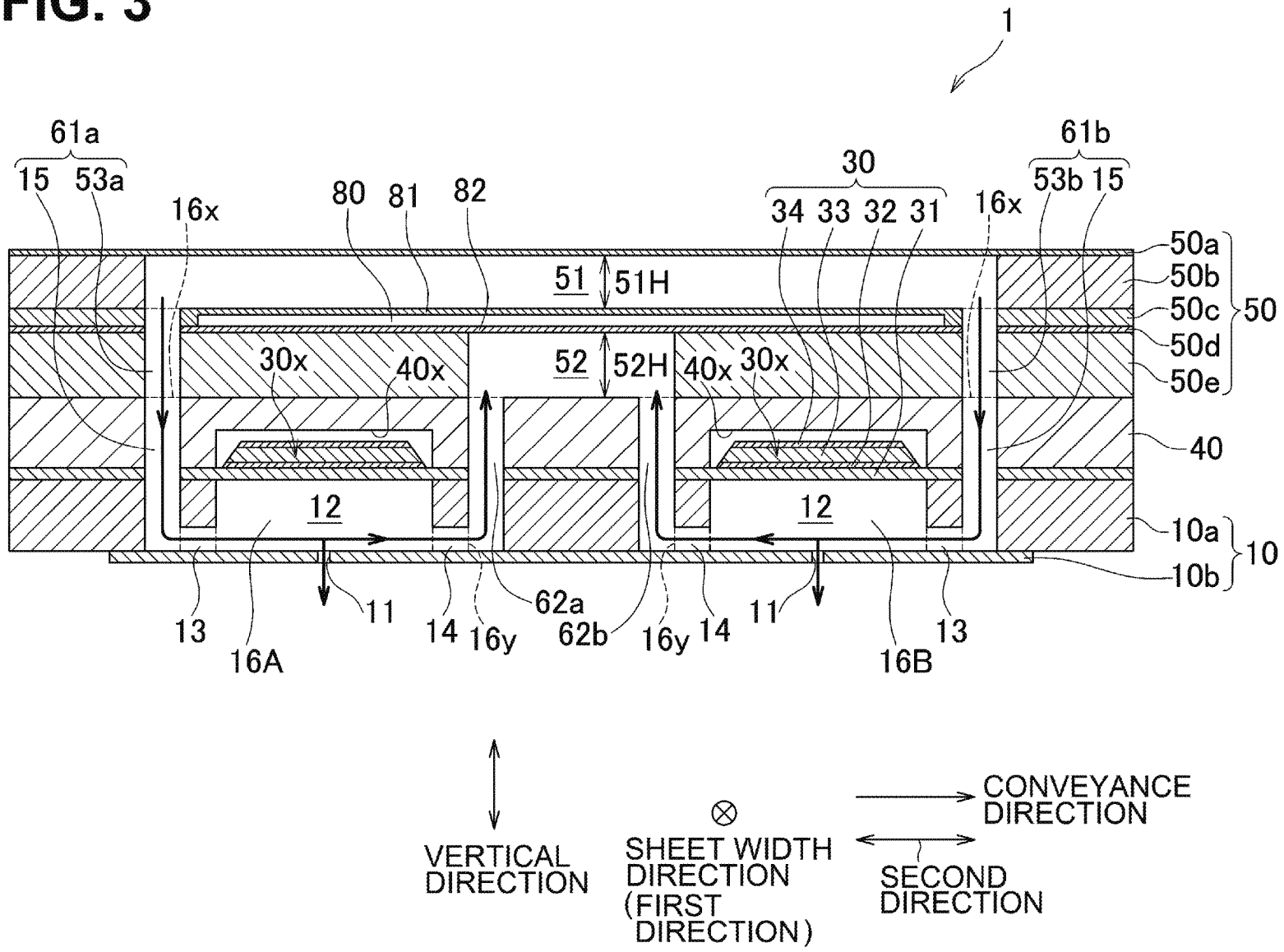
FIG. 3 is a cross-sectional view of the head, taken along a line in FIG. 2.

Referring to FIGS. 2 and 3, a configuration of the head 1 will now be described.

As depicted in FIG. 3, the head 1 includes a channel substrate 10, an actuator substrate 30, a protection substrate 40, and a casing 50.

The channel substrate 10 is disposed below the casing 50. The channel substrate 10 includes two plates 10*a* and 10*b*, which are laminated in the vertical direction. The plate 10*a* (e.g., a pressure chamber substrate as claimed) has pressure chambers 12 formed therein. The plate 10*b* (e.g., a nozzle plate as claimed) has nozzles 11 formed therein.

Each of the nozzles 11 is provided in correspondence with a respective one of the pressure chambers 12. The nozzle 11 is disposed below the corresponding pressure chamber 12 and communicates with the pressure chamber 12. The nozzle 11 is located directly below or under the pressure chamber 12 and no other channel or path is provided between the nozzle 11 and the pressure chamber 12.

As depicted in FIG. 2, the pressure chambers 12 are staggered in a longitudinal direction of the head 1. The longitudinal direction of the head 1 corresponds to a sheet width direction and is an example of a first direction as claimed. The pressure chamber 12 has a generally rectangular shape elongated in a width direction of the head 1 in a plane perpendicular to the vertical direction. The width direction of the head 1 is parallel to the conveyance direction and an example of a second direction as claimed. The nozzle is located at a central portion of the pressure chamber 12 in a plane perpendicular to the vertical direction.

The head 1 further includes a first communication channel 13 and a second communication channel 14 that communicate with respective end portions of the pressure chamber 12 in the second direction. The first communication channel 13 and the second communication channel 14 extend from the pressure chamber 12 away from each other in the second direction.

The first communication channel 13 communicates, at an end thereof, with a branch portion 15. As depicted in FIG. 3, the branch portions 15 extend in the vertical direction. Each of the branch portion 15 has a lower end communicating with the end of the communication channel 13 and an upper end located above the pressure chamber 12. The branch portions 15 constitute extension channels 61*a* and 61*b*, together with vertical channels 53*a* and 53*b* (described below), respectively. The first communication channel 13 brings the corresponding extension channel 61*a* and 61*b* and the pressure chamber 12 into communication with each other.

The nozzles 11, the pressure chambers 12, the first communication channels 13, the second communication channels 14, and the branch portions 15 constitute individual channels 16A and 16B. Each of the individual channels 16A and 16B has one nozzle 11, one pressure chamber 12, one first communication channel 13, one second communication channel 14, and one branch portion 15. The upper end of the branch portion 15 corresponds to an inlet 16*x* of the individual channel 16A, 16B. An end of the second communication channel 14 corresponds to an outlet 16*y* of the individual channel 16A, 16B.

As depicted in FIG. 2, the first individual channels 16A are equi-distantly arranged in a row along the first direction. The second individual channels 16B are arranged adjacent to the first individual channels 16A in the second direction, and are equi-distantly arranged in a row along the first direction.

The pressure chamber 12 of the first individual channel 16A is an example of a first pressure chamber as claimed. The pressure chamber 12 of the second individual channel 16B is an example of a second pressure chamber as claimed.

The nozzle 11 of the first individual channel 16A is an example of a first nozzle as claimed. The nozzle 11 of the second individual channel 16B is an example of a second nozzle as claimed.

An array of the first communication channels 13 of the individual channels 16A and an array of the first communication channels 13 of the individual channels 16B are located opposite to each other in the second direction with respect to arrays of the second communication channels 14 of the individual channels 16A and 16B. In other words, the array of the second communication channels 14 of the individual channels 16A and the array of the second communication channels 14 of the individual channels 16B are located between the array of the first communication channels 13 of the first individual channels 16A and the array of the first communication channels 13 of the second individual channels 16B, in the second direction.

As depicted in FIG. 3, the plate 10*b* is shorter than the plate 10*a* in the second direction. The plate 10*b* is bonded to a lower surface of the plate 10*a*, covering, from below, the pressure chambers 12, the first communication channels 13, the second communication channels 14, the branch portions 15, and extension channels 62*a* and 62*b*. The plate 10*a* has through holes that constitute the pressure chambers 12, portions of the branch portions 15, and portions of the extension channels 62*a* and 62*b*, and recesses that constitute the first communication channels 13 and the second communication channels 14. The recesses may be formed at the lower surface of the plate 10*a* by, for example, half-etching.

The actuator substrate 30 includes a diaphragm 31, two common electrodes 32, piezoelectric bodies 33, and individual electrodes 34 that are arranged in this order from below. The actuator substrate 30 is disposed at an upper surface of the plate 10*a*.

The diaphragm 31 is bonded to an upper surface of the plate 10*a*, covering all pressure chambers 12 formed in the plate 10*a*. In other words, the diaphragm 31 is disposed at the upper surface of the plate 10*a*. The diaphragm 31 has through holes that constitute portions of the branch portions 15 and portions of the extension channels 62*a* and 62*b*.

The two common electrodes 32 are formed on an upper surface of the diaphragm 31. Each of the common electrodes 32 is provided for a respective one of arrays of the individual channels 16A and 16B. The common electrode 32 extends in the first direction across the pressure chambers 12. Each common electrode 32 overlaps, in the vertical direction, with the pressure chambers 12 of the respective arrays of the individual channels 16A and 16B.

The piezoelectric body 33 and the individual electrode 34 are provided in correspondence with the pressure chamber 12, and overlap with the corresponding pressure chamber 12 in the vertical direction.

The driver IC 1*d* (refer to FIG. 4) is configured to electrically connect to the actuators 30*x*. The individual electrodes 34 and the common electrodes 32 electrically connect to the driver IC 1*d*, via wirings 91 and 92 (refer to FIG. 2) and wiring substrates 90 (refer to FIG. 2). The driver IC 1*d* maintains the potential of the common electrodes 32 at a ground potential but changes the potential of the individual electrodes 34. In one example, the drive IC 1*d* generates drive signals based on control signals from the controller 5, and applies the drive signals to the individual electrodes 34, so that the potential of the individual electrodes 34 may change between a predetermined drive potential and the ground potential. This may cause an actuator 30*x*, which includes portions of the diaphragm 31 and the piezoelectric body 33 sandwiched between the individual electrode 34 and the pressure chamber 12, to deform convexly toward the pressure chamber 12, resulting in change in the volume of the pressure chamber 12. This may cause pressure application to ink in the pressure chamber 12, thereby ejecting the ink from the nozzle 11.

The protection substrate 40 is bonded to the upper surface of the diaphragm 31. In other words, the protection substrate 40 is disposed above the diaphragm 31 and at an upper surface of the diaphragm 31.

The protection substrate 40 has a lower surface having two recesses 40*x* extending in the first direction. One of the recesses 40*x* overlaps, in the vertical direction, with the pressure chambers 12 of the array of the first individual channels 16A. The other one of the two recesses 40*x* overlaps, in the vertical direction, with the pressure chambers 12 of the array of the second individual channels 16B. The actuators 30*x* corresponding to the respective individual channels 16A and 16B are located in the corresponding recesses 40*x* and overlap, in the vertical direction, with the respective pressure chambers 12.

The protection substrate 40 has through holes that constitute portions of the branch portions 15 and portions of the extension channels 62*a* and 62*b*.

The extension channel 62*a* communicates with ends of the second communication channels 14 of the first individual channels 16A. The extension channel 62*b* communicates with ends of the second communication channels 14 of the second individual channels 16B. Each of the extension channels 62*a* and 62*b* extends in the vertical direction, and has a lower end communicating with the ends of the second communication channels 14, and an upper end communicating with a lower end of a return channel 52. The second communication channel 14 brings the corresponding the extension channel 62*a* and 62*b* and the pressure chamber 12 into communication with each other. In a cross section perpendicular to the vertical direction, the return channel 52 has an area (cross-sectional area) that is greater than the sum of cross-sectional areas of the extension channels 62*a* and 62*b*.

As depicted in FIG. 2, each of the branch portions 15 is provided in correspondence with a respective one of the individual channels 16A and 16B. The branch portions 15 are spaced from each other in the first direction. In contrast, the extension channels 62*a* and 62*b* are provided for the arrays of the individual channels 16A and 16B, respectively, and extend in the first direction. The outlets 16*y* of the first individual channels 16A are arranged in the first direction at lower end portions of the extension channel 62*a*. The outlets 16*y* of the second individual channels 16B are arranged in the first direction at lower end portions of the extension channel 62*b*.

Although not depicted in FIG. 3, the lower surface of the protection substrate 40 has grooves in which the wirings 91 and 92 (refer to FIG. 2) extend, and recesses, each of which receives one end of the respective wiring substrate 90 (refer to FIG. 2). The wiring 91 has one end connected to the individual electrode 34 and the other end connected to the wiring substrate 90. The wiring 92 has one end connected to the common electrode 32 and the other end connected to the wiring substrate 90. Each of the wirings 91 and 92 extends through a portion between the branch portions 15, which are arranged in the first direction, toward an end of the head 1 in the second direction.

Each of the wiring substrates 90 includes a chip on film (COF), and is disposed at a respective end of the head 1 in the second direction. The wiring substrate 90 has one end (refer to FIG. 2) fixed on the diaphragm 31 and the other end connected to the controller 5 (refer to FIGS. 1 and 4). The driver IC 1*d* (refer to FIG. 4) is mounted on a portion of the wiring substrate 90 between its one end and the other end.

As depicted in FIG. 3, the casing 50 is bonded on an upper surface of the protection substrate 40. The casing 50 includes five plates 50*a*-50*e* that are laminated in the vertical direction. The casing 50 has through holes formed in the plates 50*b*-50*e*. The through holes define a supply channel 51 (e.g., a first common channel as claimed), the return channel 52 (e.g., a second common channel as claimed), and vertical channels 53*a* and 53*b*. The return channel 52 has a lower surface defined by the protection substrate 40. The upper surface of the protection substrate 40 serves as the lower surface of the return channel 52.

The vertical channels 53*a* and 53*b* do not overlap with the recesses 40*x* in the vertical direction. If the vertical channels 53*a* and 53*b* should overlap with the recesses 40*x* in the vertical direction, the plate 50*e* and the protection substrate 40 might not be securely pressed against each other when bonded together, resulting in bonding failure. The configuration of the illustrative embodiment may prevent or reduce bonding failures.

The channels 51, 52, 53*a*, and 53*b* are disposed above the individual channels 16A and 16B. The supply channel 51 overlaps, in the vertical direction, with all of the pressure chambers 12 of the head 1. The return channel 52 and the vertical channels 53*a* and 53*b* are located below the supply channel 51 and overlap, in the vertical direction, with the supply channel 51. The supply channel 51 is longer in the second direction than the return channel 52 and protrudes to both sides of the return channel 52 in the second direction. The supply channel 51 has a dimension 51H in the vertical direction that is shorter than a dimension 52H of the return channel 52 in the vertical direction. The return channel 52 has a channel area that is perpendicular to the first direction. The channel area of the return channel 52 is smaller than that of the supply channel 51.

As depicted in FIG. 2, each of the supply channel 51 and the return channel 52 extends in the first direction. Each of the vertical channels 53*a* and 53*b* is located at a respective end of the supply channel 51 in the second direction, and extends in the first direction. In the first direction, the vertical channels 53*a* and 53*b* have the same length as the supply channel 51.

The supply channel 51 communicates with the inlets 16*x* of all of the individual channels 16A and 16B formed in the head 1, via the vertical channels 53*a* and 53*b*. The vertical channel 53*a* brings one end of the supply channel 51 in the second direction into communication with the inlets 16*x* of the first individual channels 16A. The vertical channel 53*b* brings the other end of the supply channel 51 in the second direction into communication with the inlets 16*x* of the second individual channels 16B. The inlets 16*x* are arranged in the first direction at lower end portions of the vertical channels 53*a* and 53*b*. The supply channel 51 communicates with the inlets 16*x* of the first individual channels 16A via the vertical channel 53*a*, and with the inlets 16*x* of the second individual channels 16B via the vertical channel 53*b*.

The return channel 52 is disposed directly above the extension channels 62*a* and 62*b*. The return channel 52 communicates with the outlets 16*y* of all of the individual channels 16A and 16B formed in the head 1, via the extension channels 62*a* and 62*b*. Each of the extension channels 62*a* and 62*b* is located, below the return channel 52, at a respective end of the return channel 52 in the second direction. Each of the extension channels 62*a* and 62*b* extends in the first direction. The extension channels 62*a* and 62*b* have the same length in the first direction as the return channel 52.

As depicted in FIG. 3, the extension channel 61*a* (e.g., a first extension channel as claimed) includes the vertical channel 53*a*, and the branch portions 15 (of the first individual channels 16A) that branch from the vertical channel 53*a*. The extension channel 61*b* (e.g., an example of a third extension channel as claimed) includes the vertical channel 53*b*, and the branch portions 15 (of the second individual channels 16B) that branch from the vertical channel 53*b*. Each of the extension channels 61*a* and 61*b* is defined by through holes formed in the plates 50*c*, 50*d*, and 50*e* of the casing 50, the protection substrate 40, the diaphragm 31, the plate 10*a* of the channel substrate 10. The branch portions 15 are formed in the protection substrate 40, the diaphragm 31, and the plate 10*a*. The branch portion 15 is an example of a portion of the first extension channel or a portion of the third extension channel, as claimed. Each branch portion 15 is disposed between the supply channel 51 and a respective one of the pressure chambers 12 of the individual channels 16A and 16B.

The extension channel 61*a* extends downward from one end of the supply channel 51 in the second direction. The extension channel 61*b* extends downward from the other end of the supply channel 51 in the second direction.

The extension channel 61*a* and the first communication channels 13 are located at one side of arrays of the pressure chambers 12 of the first and second individual channels 16A and 16B in the second direction. The extension channel 61*b* and the first communication channels 13 are located at the other side of the arrays of the pressure chambers 12 of the first and second individual channels 16A and 16B in the second direction. The extension channels 61*a* and 61*b*, and the first communication channels 13 do not overlap with any pressure chambers 12 of the head 1 in the vertical direction.

The extension channel 62*a* (e.g., a second extension channel as claimed) extends downward from one end of the return channel 52 in the second direction. The extension channel 62*b* (e.g., a fourth extension channel as claimed) extends downward from the other end of the return channel 52 in the second direction. Each of the extension channels 62*a* and 62*b* is defined by through holes formed in the protection substrate 40, the diaphragm 31, and the plate 10*a* of the channel substrate 10.

The return channel 52, the extension channels 62*a*, 62*b*, and the second communication channel 14 are located between the array of the pressure chambers 12 of the first individual channels 16A and the array of the pressure chambers 12 of the second individual channels 16B in the second direction. The return channel 52, the extension channels 62*a* and 62*b*, and the second communication channels 14 do not overlap with any pressure chambers 12 of the head 1 in the vertical direction.

The plate 10*b* defines lower ends of the communication channels 13 and 14, and the extension channels 61*a*, 61*b*, 62*a*, and 62*b*. The lower ends of the communication channels 13 and 14 and the extension channels 61*a*, 61*b*, 62*a*, and 62*b* are located at a level in contact with the nozzles 11 in the vertical direction. A distance in the vertical direction between the nozzle 11 and the lower ends of the communication channels 13 and 14, and the extension channels 61*a*, 61*b*, 62*a*, and 62*b* (which is substantially zero in the illustrative embodiment) is shorter than a distance in the vertical direction between the actuator substrate 30 and the lower ends of the communication channels 13 and 14, and the extension channels 61*a*, 61*b*, 62*a*, and 62*b*.

A damper chamber 80 is located between the supply channel 51 and the return channel 52 in the vertical direction. The damper chamber 80 overlaps, in the vertical direction, with a particular region of the supply channel 51. The particular region does not include portions of the supply channel 51 where the vertical channels 53*a* and 53*b* are connected. The damper chamber 80 also overlaps, in the vertical direction, with an entire region of the return channel 52. The damper chamber 80 communicates with the atmosphere via through holes 80*x* and 80*y* (refer to FIG. 2) located at respective ends thereof in the first direction. The pressure in the damper chamber 80 is the same as the atmospheric pressure.

The damper chamber 80 includes a first damper film 81 that partially defines the supply channel 51 and a second damper film 82 that partially defines the return channel 52. For the damper chamber 80, the plate 50*c* has a recess formed in a lower surface thereof, by, for example, half-etching. A portion of a bottom (e.g., a most recessed portion) of the recess overlapping with the supply channel 51 in the vertical direction serves as the first damper film 81. The plate 50*d* covers the recess from below and is bonded to a lower surface of the plate 50*c*. A portion of the plate 50*d* that covers the recess and overlaps with the return channel 52 in the vertical direction serves as the second damper film 82.

The first damper film 81 is longer in the second direction than the second damper film 82. The first damper film 81 has a Young's modulus that is greater than a Young's modulus of the second damper film 82. For example, the plate 50*c* includes metal (e.g., SUS) whereas the plate 50*d* includes resin (e.g., polyimide).

A thickness of the plate 50*a* that defines an upper surface of the supply channel 51 is substantially the same as a thickness of the damper films 81 and 82. The damper films are thus provided both above and below the supply channel 51.

As depicted in FIG. 2, the return channel 52 is longer than the supply channel 51 in the first direction and protrudes to both sides of the supply channel 51 in the first direction. In other words, the supply channel 51 is shorter in the first direction than the return channel 52.

The upper surface of the supply channel 51 has a supply opening 51*x* (e.g., a first opening as claimed) formed therein. The supply opening 51*x* is located at a central portion of the supply channel 51 in a plane perpendicular to the vertical direction. The supply channel 51 communicates with a sub-tank (not depicted) via the supply opening 51*x*. The sub-tank communicates with a main tank and stores ink from the main tank. The ink in the sub-tank is supplied to the supply channel 51 via the supply opening 51*x* as a circulation pump 7*p* (refer to FIG. 4) is driven under the control of the controller 5. The ink flowing into the supply channel 51 is supplied to the respective individual channels 16A via the vertical channel 53*a* and to the respective individual channels 16B via the vertical channel 53*b*.

The return channel 52 has an upper surface defined by the plate 50*d*. The upper surface of the return channel 52 has a return opening 52*x* (e.g., a second opening as claimed) formed therein. The return opening 52*x* extends through the plates 50*a*-50*d* and is located at a position not overlapping with the supply channel 51. The return channel 52 communicates with the sub-tank (not depicted) via the return opening 52*x*. The ink in the individual channels 16A and 16B flows into the return channel 52 via the extension channels 62*a* and 62*b* and returns to the sub-tank via the return opening 52*x*.

The ink supplied from the supply channel 51 flows into the pressure chambers 12 of the respective individual channels 16A and 16B, via the branch portions 15 and the first communication channels 13, as depicted in FIG. 3. The ink in the pressure chambers 12 moves in the second direction. A portion of the ink is ejected from the nozzles 11, and the remaining ink flows into the return channel 52, via the second communication channels 14 and the extension channels 62*a* and 62*b*.

The ink is thus circulated between the sub-tank and the head 1, thereby achieving discharge of air in channels of the head 1 and preventing or reducing increases in viscosity of ink. If the ink includes settling ingredient (such as pigment that causes settling), the ingredient may be stirred and may not settle.

In view of maintaining meniscuses in the nozzles 11, a dimension of the return channel 52 in the second direction may preferably be approximately 3 mm. A dimension 52H of the return channel 52 in the vertical direction may preferably be approximately 0.3 mm. A dimension of each of the vertical channels 53*a* and 53*b* in the second direction may preferably be approximately 1.5 mm. A dimension of each of the vertical channels 53*a* and 53*b* in the vertical direction may preferably be approximately 0.205 mm. A circulation flow rate per the individual channel 16A, 16B may preferably be approximately 50 nl/s.

As described above, in the first illustrative embodiment, the supply channel 51, the return channel 52, and the pressure chambers 12 are located at different positions in the vertical direction. Additionally, the supply channel 51 overlaps with the pressure chambers 12 in the vertical direction but the return channel 52 does not overlap with the pressure chambers 12 in the vertical direction (refer to FIG. 3). This configuration may increase volumes of the channels 51 and 52 while preventing or reducing increases in the size of the head 1 in the second direction. The return channel 52 is located at different position in the vertical direction from the supply channel 51 and the pressure chambers 12. The configuration may allow a dimension of the return channel 52 in the vertical direction to be flexibly increased, thereby increasing the volume of the return channel 52. In the illustrative embodiment, the supply channel 51 is located higher than the return channel 52. This configuration may prevent the air from entering from the supply channel 51 into the pressure chambers 12, due to buoyancy. Further, in the illustrative embodiment, the return channel 52 does not overlap with the pressure chambers 12 in the vertical direction. This configuration may maintain regions for the actuators 30*x* and allow the actuators 30*x* to deform sufficiently.

The return channel 52 has a channel area that is smaller than a channel area of the supply channel 51 (refer to FIG. 3). This may increase a flow rate in the return channel 52, allowing the air to be discharged effectively via the return channel 52.

The damper chamber 80 is located between the supply channel 51 and the return channel 52 in the vertical direction (refer to FIG. 3). As compared with a configuration in which a damper chamber is individually provided for the supply channel 51 and the return channel 52, the configuration of the illustrative embodiment may simplify the configuration of the head 1 and decrease the size of the head 1 in the vertical direction.

The damper chamber 80 communicates with the atmosphere via the through holes 80*x* and 80*y* located at respective ends thereof in the first direction (refer to FIG. 2). This configuration may allow the damper films 81 and 82 to readily deform as compared with a configuration in which the damper chamber 80 is sealed, and may enhance a damping effect of the supply channel 51 and the return channel 52. The two through holes 80*x* and 80*y*, which allow communication with the atmosphere, may help to effectively release the adhesives between the plates of the casing 50.

The damper film 81 is longer in the second direction than the second damper film 82 (refer to FIG. 3). The Young's modulus of the damper film 81 is greater than the Young's modulus of the damper film 82. In a case where the damper films 81 and 82 have the same Young's modulus that is relatively low, the damper film 81, which is longer in the second direction, may excessively deform and attach to the damper film 82, resulting in insufficient space for the damper chamber 80. In the illustrative embodiment, the damper film 81 is longer in the second direction and has a greater Young's modulus than the damper film 82. This may prevent the damper film 81 from readily deforming but may allow the damper film 82 to readily deform, thereby preventing the damper films 81 and 82 from attaching to each other and ensuring the space for the damper chamber 80.

The supply channel 51 has the supply opening 51*x*, in the upper surface thereof. The return channel 52 has the return opening 52*x* in the upper surface thereof. The return opening 52*x* does not overlap with the supply channel 51 (refer to FIG. 2). In a configuration in which the supply channel 51 and the return channel 52 overlap with each other in the vertical direction, tubes may be attached to the supply opening 51*x* and the return opening 52*x* from above, which may facilitate the attachment of the tubes.

The supply channel 51 is longer in the second direction than the return channel 52 and shorter in the vertical direction than the return channel 52 (refer to FIG. 3). This configuration may reduce a difference in a channel resistance between the supply channel 51 and the return channel 52, and reliably maintain meniscuses.

The extension channel 61*a* and the first communication channels 13 of the first individual channels 16A do not overlap, in the vertical direction, with any pressure chambers 12 of the first individual channels 16A (refer to FIG. 3). The extension channel 61*b* and the first communication channels 13 of the second individual channels 16B do not overlap, in the vertical direction, with any pressure chambers 12 of the second individual channels 16B. This configuration may maintain regions for the actuators 30*x* and may allow the actuators 30*x* to deform sufficiently.

The extension channel 62*a* and the second communication channels 14 of the first individual channels 16A do not overlap, in the vertical direction, with any pressure chambers 12 of the first individual channels 16A (refer to FIG. 3). The extension channel 62*b* and the second communication channels 14 of the second individual channels 16B do not overlap, in the vertical direction, with any pressure chambers 12 of the second individual channels 16B. This configuration may maintain regions for the actuators 30*x* and may allow the actuators 30*x* to deform sufficiently.

A distance in the vertical direction between the second communication channel 14 and the nozzle 11 is shorter than a distance in the vertical direction between the second communication channel 14 and the actuator substrate 30 (refer to FIG. 3). In this configuration, the second communication channels 14 are located closer to the nozzles 11 in the vertical direction, which may allow ink near the nozzles 11 to be readily collected. Accordingly, increases in the viscosity of ink near the nozzles 11 may be prevented or reduced.

The plate 10*b* defines portions of the extension channels 62*a* and 62*b* and the second communication channels 14 (refer to FIG. 3). In this configuration, the second communication channels 14 are located closer to the nozzles 11 in the vertical direction. Thus, such a configuration may be effectively achieved that readily collects ink near the nozzles 11.

The supply channel 51 and the return channel 52 communicate with both of the first individual channels 16A and the second individual channels 16B. The supply channel 51 and the return channel 52 are disposed above the pressure chambers 12 of the arrays of the first individual channels 16A and the second individual channels 16B. The supply channel 51 overlaps, in the vertical direction, with the pressure chambers 12 of the arrays of the first individual channels 16A and the second individual channels 16B. The return channel 52 does not overlaps, in the vertical direction, with the pressure chambers 12 of the arrays of the first individual channels 16A and the second individual channels 16B (refer to FIG. 3). As compared with a configuration in which the supply channel 51 and the return channel 52 are provided for the respective arrays of the first individual channels 16A and the second individual channels 16B, the configuration of the illustrative embodiment may facilitate configuration of channels and allow the volumes of the channels 51 and 52 to be increased readily.

Portions of the extension channels 61*a* and 61*b* formed in the protection substrate 40 serve as the branch portions 15 of the individual channels 16A and 16B (refer to FIG. 3). In this configuration, each of the wirings 91 and 92, as depicted in FIG. 2, extends in the second direction through a portion between the branch portions 15 toward the corresponding wiring substrate 90 including the driver IC 1*d*. The wirings 91 and 92 corresponding to the array of the first individual channels 16A and the wirings 91 and 92 corresponding to the array of the second individual channels 16B extend away from each other in the second direction. This configuration may facilitate wiring operations.

<Second Illustrative Embodiment>

Figure 5:
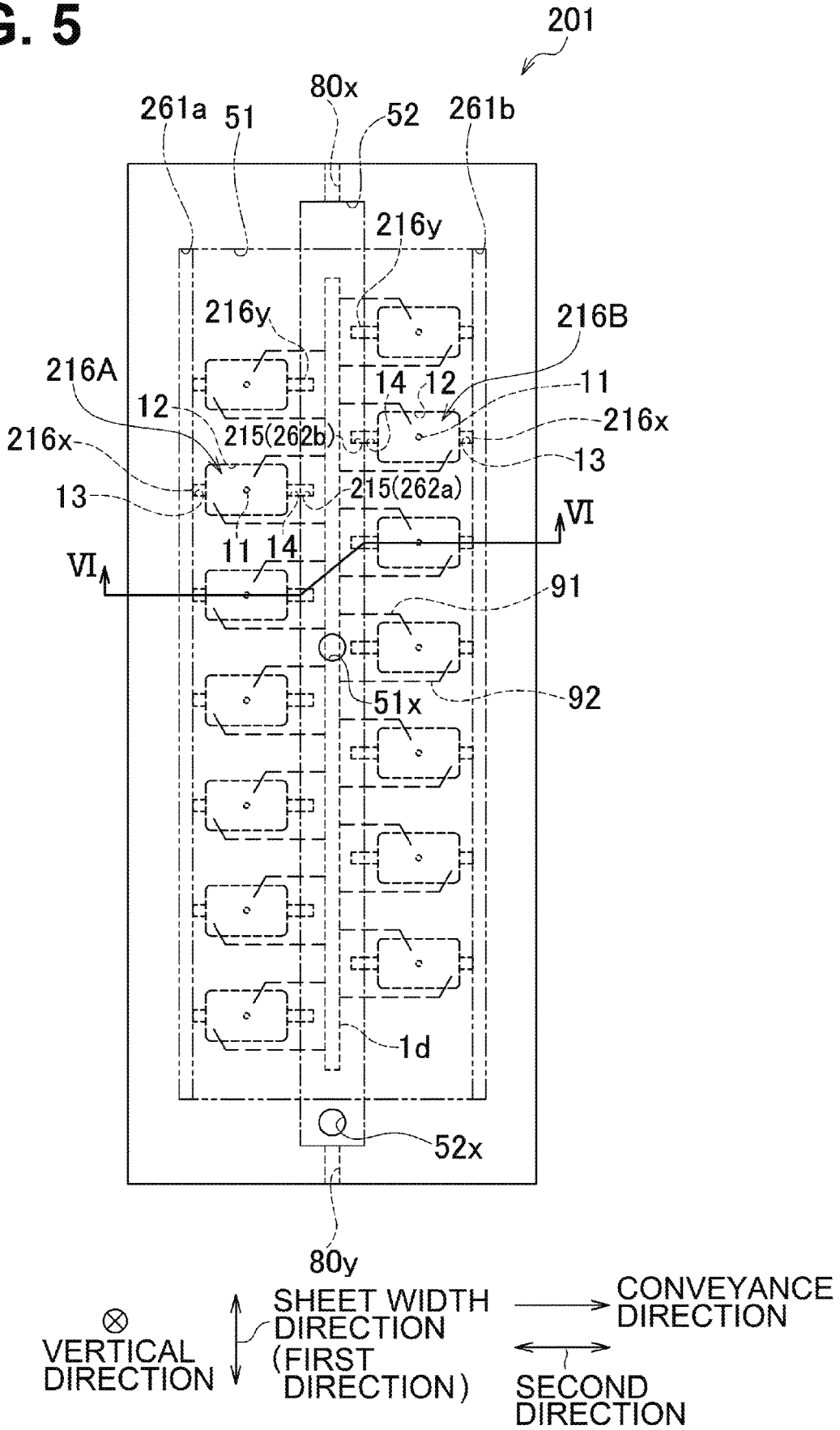
FIG. 5 is a plan view of a head in a second illustrative embodiment according to aspects of the disclosure.
Figure 6:
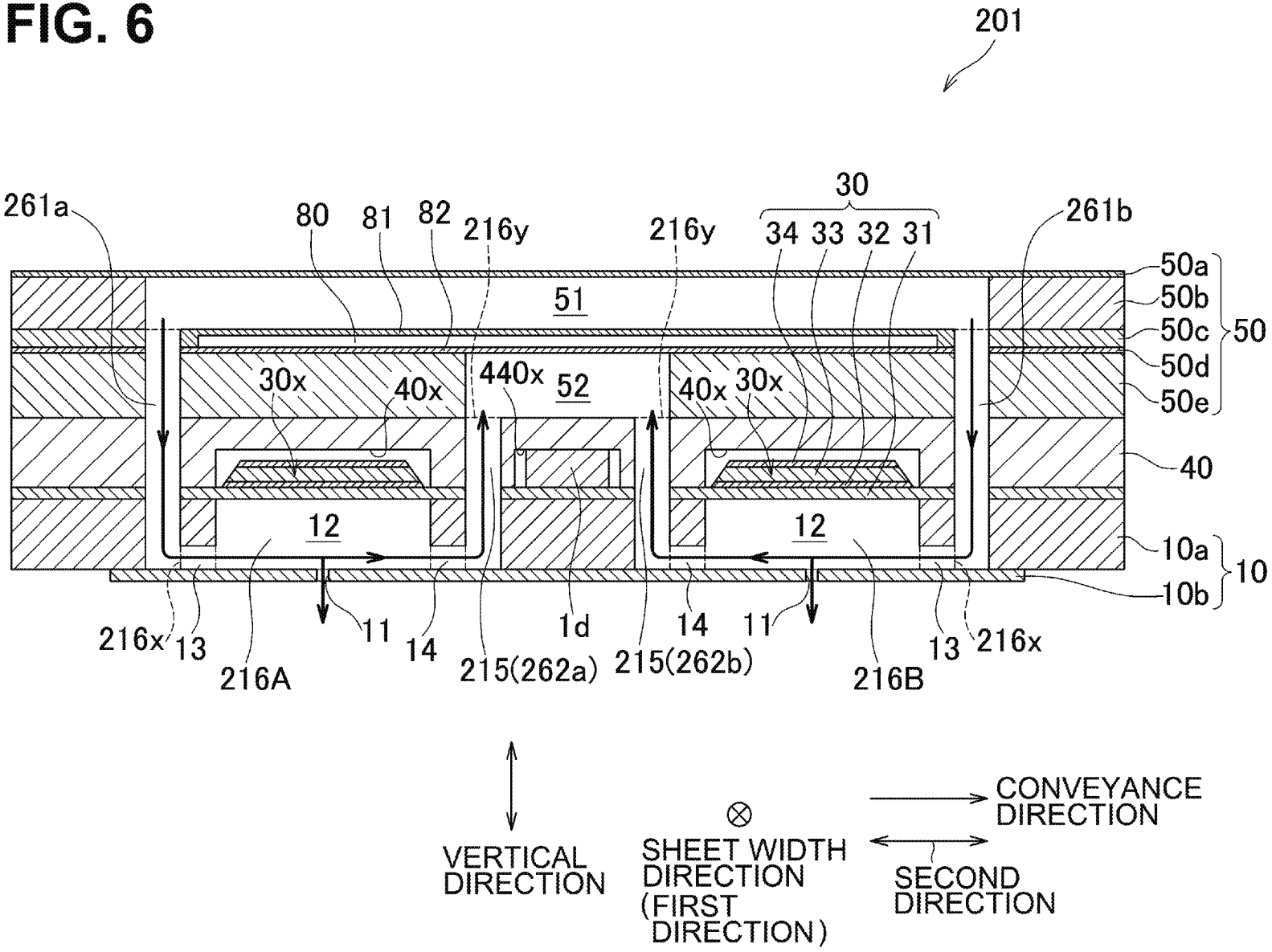
FIG. 6 is a cross-sectional view of the head in the second illustrative embodiment, taken along a line VI-VI in FIG. 5.

Referring to FIGS. 5 and 6, a head 201 according to a second illustrative embodiment of the disclosure will be described below. Like numerals in the drawings denote like components and the detailed description of those components described above is omitted, with respect to FIGS. 5 and 6.

As depicted in FIG. 5, first individual channels 216A are equi-distantly arranged in a row along the first direction, similar to the first individual channels 16A of the first illustrative embodiment. Second individual channels 216B are arranged adjacent to the first individual channels 216A in the second direction and are equi-distantly arranged in a row along the first direction, similar to the second individual channels 16B of the first illustrative embodiment.

The pressure chamber 12 of the first individual channel 216A is an example of a first pressure chamber as claimed. The pressure chamber 12 of the second individual channel 216B is an example of a second pressure chamber as claimed.

The nozzle 11 of the first individual channel 216A is an example of a first nozzle as claimed. The nozzle 11 of the second individual channel 216B is an example of a second nozzle as claimed.

The individual channels 216A and 216B have configurations different from those of the individual channels 16A and 16B of the first illustrative embodiment, respectively. Each of the individual channels 216A and 216B has one nozzle 11, one pressure chamber 12, one first communication channel 13, one second communication channel 14, and one branch portion 215. In other words, each of the individual channels 216A and 216B includes the branch portion 215 for the branch portion 15. As depicted in FIG. 6, the branch portion 215 extends in the vertical direction. The branch portion 215 has a lower end communicating with an end of the second communication channel 14 and an upper end communicating with a lower end of the return channel 52.

An end of the first communication channel 13 corresponds to an inlet 216*x* of the individual channel 216A, 216B. An upper end of the branch portion 215 corresponds to an outlet 216*y* of the individual channel 216A, 216B. The outlets 216*y* are staggered in the first direction at the lower surface of the return channel 52 (refer to FIG. 5).

As depicted in FIG. 6, the plate 10*b* is shorter than the plate 10*a* in the second direction. The plate 10*b* is bonded to the lower surface of the plate 10*a*, covering, from below, the pressure chambers 12, the first communication channels 13, the second communication channels 14, the branch portions 215, and extension channels 261*a* and 261*b*. The plate 10*a* has through holes that constitute the pressure chambers 12, portions of the branch portions 215, and portions of the extension channels 261*a* and 261*b*, and recesses that constitute the first communication channels 13 and the second communication channels 14.

As depicted in FIG. 5, each of the branch portions 215 is provided in correspondence with a respective one of the individual channels 216A and 216B. The branch portions 215 are spaced from each other in the first direction. In contrast, the extension channels 261*a* and 261*b* are provided for arrays of the individual channels 216A and 216B, respectively, and extend in the first direction.

The branch portion 215 of the first individual channel 216A constitutes an extension channel 262*a* (e.g., a second extension channel as claimed). The branch portion 215 of the second individual channel 216B constitutes an extension channel 262*b* (e.g., a fourth extension channel as claimed). The branch portion 215 is an example of a portion of the second extension channel or a portion of the fourth extension channel as claimed. In the second illustrative embodiment, the extension channel 261*a* (e.g., a first extension channel as claimed) and the extension channel 261*b* (e.g., a third extension channel as claimed) extend in the first direction without branching off. The extension channels 262*a* and 262*b* branch off.

As depicted in FIG. 6, each of the diaphragm 31 and the protection substrate 40 has through holes that constitute portions of the branch portions 215, and portions of the extension channels 261*a* and 261*b*.

The protection substrate 40 has a lower surface having two recesses 40*x* and one IC accommodating space 440*x*. The IC accommodating space 440*x* is located between the extension channels 262*a* and 262*b* in the second direction, and extends in the first direction. The driver IC 1*d* (e.g., a drive circuit as claimed) is located in the IC accommodating space 440*x*. The driver IC 1*d* is disposed at the upper surface of the diaphragm 31 and extends in the first direction.

Although not depicted in FIG. 6, the lower surface of the protection substrate 40 has recesses through which the wirings 91 and 92 (refer to FIG. 5) extend. The wiring 91 has one end connected to the individual electrode 34 and the other end connected to the driver IC 1*d*. The wiring 92 has one end connected to the common electrode 32 and the other end connected to the driver IC 1*d*. Each of the wirings 91 and 92 extends in the second direction toward the driver IC 1*d* (e.g., toward the center of the head 201 in the second direction) through a portion between the branch portions 215 arranged in the first direction.

As depicted in FIG. 6, the casing 50 includes the supply channel 51, the return channel 52, and portions of the extension channels 261*a* and 261*b*.

The extension channels 261*a* and 261*b* do not overlap with the recesses 40*x* in the vertical direction. If the extension channels 261*a* and 261*b* should overlap with the recesses 40*x* in the vertical direction, the plate 50*e* and the protection substrate 40 might not be securely pressed against each other when bonded together, resulting in bonding failure. The configuration of the second illustrative embodiment may prevent or reduce bonding failures.

The extension channels 261*a* and 261*b* are located below the supply channel 51 and overlap, in the vertical direction, with the supply channel 51. As depicted in FIG. 5, each of the extension channels 261*a* and 261*b* is located at a respective end of the supply channel 51 in the second direction, and extends in the first direction. The extension channels 261*a* and 261*b* have the same length in the first direction as the supply channel 51.

The supply channel 51 communicates with all of the inlets 216*x* of the individual channels 216A and 216B formed in the head 201, via the extension channels 261*a* and 261*b*. The extension channel 261*a* brings one end of the supply channel 51 in the second direction into communication with the inlets 216*x* of the first individual channels 216A. The extension channel 261*b* brings the other end of the supply channel 51 in the second direction into communication with the inlets 216*x* of the second individual channels 216B. The inlets 216*x* of the first individual channels 216A are arranged in the first direction at lower end portions of the extension channel 261*a*. The inlets 216*x* of the second individual channels 216B are arranged in the first direction at lower end portions of the extension channel 261*b*. The supply channel 51 communicates with the inlets 216*x* of the first individual channels 216A via the extension channel 261*a*, and with the inlets 216*x* of the second individual channels 216B via the extension channel 261*b*.

The return channel 52 is disposed directly above the branch portions 215 (e.g., the extension channels 262*a* and 262*b*). The return channel 52 communicates with all of the outlets 216*y* of the individual channels 216A and 216B formed in the head 201.

The extension channel 261*a* extends downward from one end of the supply channel 51 in the second direction. The extension channel 261*b* extends downward from the other end of the supply channel 51 in the second direction.

The extension channel 261*a* and the first communication channels 13 are located at one side of arrays of the pressure chambers 12 of the first and second individual channels 216A and 216B in the second direction. The extension channel 261*b* and the first communication channels 13 are located at the other side of the arrays of the pressure chambers 12 of the first and second individual channels 216A and 216B in the second direction. The extension channels 261*a* and 261*b*, and the first communication channels 13 do not overlap with any pressure chambers 12 of the head 201 in the vertical direction.

Some branch portions 215 (the extension channels 262*a*) extend downward from one end of the return channel 52 in the second direction. Other branch portions 215 (the extension channels 262*b*) extend downward from the other end of the return channel 52 in the second direction. The branch portions 215 (the extension channels 262*a* and 262*b*) are defined by through holes formed in the protection substrate 40, the diaphragm 31, and the plate 10*a* of the channel substrate 10.

The return channel 52, the branch portions 215 (the extension channels 262*a*, 262*b*), and the second communication channels 14 are located between the array of the pressure chambers 12 of the first individual channels 216A and the array of the pressure chambers 12 of the second individual channels 216B, in the second direction. The return channel 52, the extension channels 262*a* and 262*b*, and the second communication channels 14 do not overlap with any pressure chambers 12 of the head 201 in the vertical direction. In other words, each branch portion 215 corresponding to the first individual channel 216A and the second individual channel 216B is disposed between a respective one of the pressure chambers 12 of the first individual channels 216A and a respective one of the pressure chambers 12 of the second individual channels 216B in the second direction.

The plate 10*b* defines lower ends of the communication channels 13 and 14, and the extension channels 261*a*, 261*b*, 262*a*, and 262*b*. The lower ends of the communication channels 13 and 14 and the extension channels 261*a*, 261*b*, 262*a*, and 262*b* are located at a position in contact with the nozzles 11 in the vertical direction. A distance in the vertical direction between the nozzle 11 and the lower ends of the communication channels 13 and 14, and the extension channels 261*a*, 261*b*, 262*a*, and 262*b* (which is substantially zero in the second illustrative embodiment) is shorter than a distance in the vertical direction between the actuator substrate 30 and the lower ends of the communication channels 13 and 14, and the extension channels 261*a*, 261*b*, 262*a*, and 262*b*.

Ink is supplied to the supply channel 51 via the supply opening 51*x* (refer to FIG. 2) as the circulation pump 7*p* (refer to FIG. 4) is driven. The ink is supplied to the individual channels 216A via the extension channel 261*a* and the individual channels 216B via the extension channel 261*b*. The ink supplied to the respective individual channels 216A and 216B flows, via the first communication channels 13, into the pressure chambers 12. The ink in the pressure chambers 12 moves in the second direction. A portion of the ink is ejected from the nozzles 11, and the remaining ink flows into the return channel 52 via the second communication channels 14, and the branch portions 215 (the extension channels 262*a* and 262*b*). The ink is returned to the sub-tank via the return opening 52*x* (refer to FIG. 2).

As described above, in the second illustrative embodiment, the portions of the extension channels 262*a* and 262*b* formed in the protection substrate 40 serve as the branch portions 215 of the individual channels 216A and 216B (refer to FIG. 6). In this configuration, as depicted in FIG. 5, each of the wirings 91 and 92 extends through a portion between the branch portions 215 toward a position between the array of the pressure chambers 12 of the first individual channels 216A and the array of the pressure chambers 12 of the second individual channels 216B in the second direction. This configuration may facilitate wiring operations.

The driver IC 1*d* is located between the extension channels 262*a* and 262*b* in the second direction. Each of the wirings 91 and 92 extends through a portion between the branch portions 215 toward the driver IC 1*d* between the array of the pressure chambers 12 of the first individual channels 216A and the array of the pressure chambers 12 of the second individual channels 216B in the second direction (refer to FIG. 5). This configuration may reduce the size of the head 201 in the second direction, as compared with a configuration in which the wirings 91 and 92 corresponding to the array of the first individual channels 216A and the wirings 91 and 92 corresponding to the array of the second individual channels 216B extend away from each other in the second direction.

<Modifications>

While aspects of the disclosure have been described in detail with reference to the specific embodiments thereof, various changes, arrangements and modifications may be applied therein as will be described below.

For example, in the illustrative embodiments, the supply channel is an example of a first common channel, and the return channel is an example of a second common channel. Alternatively, the return channel may be an example of a first common channel, and the supply channel may be an example of a second common channel. The first common channel may communicate with one of the inlet and the outlet of the respective individual channel, and the second common channel may communicate with the other one of the inlet and outlet of the respective individual channel.

The first common channel may not necessarily overlap with an entire of each pressure chamber in the vertical direction. Alternatively, the first common channel may overlap with a portion of each pressure chamber in the vertical direction.

The damper chamber may or may not communicate with the atmosphere at one end thereof in the first direction.

In the illustrative embodiments, each of the first damper film and the second damper film includes different material, thereby achieving a greater Young's modulus of the first damper film than a Young's modulus of the second damper film. Alternatively, each of the first damper film and the second damper film may have different thickness to achieve a greater Young's modulus of the first damper film than a Young's modulus of the second damper film. For example, the first damper film may be thicker than the second damper film.

The first damper film and the second damper film may have the same Young's modulus. For example, the first damper film and the second damper film may both include resin (e.g., polyimide).

The damper chamber may not necessarily be provided between the first common channel and the second common channel. For example, the damper chamber may be provided individually for the first and the second common channels. Further, the damper chamber may be provided at a side surface of the common channel, instead of providing at an upper or lower surface of the common channel. The damper chamber and/or the damper films may not necessarily be provided for the common channel.

The casing may not necessarily include a plurality of plates. For example, the casing may be integrally formed of resin by molding.

In the first illustrative embodiment, the vertical channels 53*a* and 53*b* extend in the first direction and communicate with the individual channels 16A and 16B. In some embodiments, each of the vertical channels 53*a* and 53*b* may be provided for a corresponding one of the branch portions 15, constituting the individual channel 16A, 16B. In this configuration, upper ends of the vertical channels 53*a* and 53*b* correspond to the inlets 16*x* of the individual channels 16A and 16B.

In the first illustrative embodiment, the communication channels 13 and 14, and the branch portions 15 constitute the individual channels 16A and 16B. In some embodiments, the communication channels 13 and 14, and the branch portions 15 may extend in the first direction, similar to the vertical channels 53*a* and 53*b*. In this configuration, a portion of a side surface of the pressure chamber 12 in the second direction connected to or communicating with the communication channel 13 corresponds to the inlet 16*x* of the individual channel 16A, 16B. A portion of a side surface of the pressure chamber 12 in the second direction connected to or communicating with the communication channel 14 corresponds to the outlet 16*y* of the individual channel 16A, 16B.

In the second Illustrative embodiment, the extension channels 261*a* and 261*b* extend in the first direction and communicate with the individual channels 216A and 216A. In some embodiments, each of the extension channels 261*a* and 261*b* may be provided for a corresponding one of the first communication channels 13, constituting the individual channels 216A and 216B. In this configuration, upper ends of the extension channels 261*a* and 261*b* correspond to the inlets 216*x* of the individual channels 216A and 216B, respectively.

In the second illustrative embodiment, the extension channels 262*a* and 262*b* constitute the individual channels 216A and 216B, respectively. The individual channels 216A and 216B may extend in the first direction, similar to the extension channels 261*a* and 261*b*. In this configuration, ends of the second communication channels 14 correspond to the outlets 216*y* of the individual channels 216A and 216B.

The first common channel and the second common channel may be provided for each array of the first individual channels and the second individual channels. In other words, in the illustrative embodiments, the first common channel and the second common channel communicate with both arrays of the first individual channels and the second individual channels. Alternatively, the first common channel and the second common channel may communicate with the array of the first individual channels but not communicate with the array of the second individual channels. Other common channels that communicate with the array of the second individual channels may be provided. In this configuration, different types (e.g., colors) of liquid may be supplied to the respective arrays of the first individual channels and the second individual channels.

The liquid ejection head may not necessarily include second individual channels, but may include the first individual channels and the first and second common channels that communicate with the first individual channels.

In the above-described illustrative embodiments (in FIG. 1), the head unit 1*x* includes four heads 1. However, the number of heads 1 in the head unit 1*x* is not limited to a particular number. For example, a head unit 1*x* may include six or eight heads 1. An apparatus to which aspects of the disclosure are applied may be such an apparatus that includes one head, other than an apparatus that includes a head unit including a plurality of heads.

Aspects of the disclosure may be applied to, for example, facsimile machines, copiers, and multi-functional devices other than printers. Aspects of the disclosure may be applied to a liquid ejection apparatus used for a purpose other than image recording. For example, aspects of the disclosure may be applied to a liquid ejection apparatus that forms a conductive pattern by ejecting conductive liquid on a substrate.

What is claimed is:

1. A liquid ejection head, comprising:

a plurality of first individual channels arranged in a first direction perpendicular to a vertical direction;

a first common channel extending in the first direction, the first common channel communicating with the first individual channels; and a second common channel located below the first common channel and extending in the first direction, the second common channel communicating with the first individual channels, wherein each of the first individual channels includes one of first nozzles, and one of first pressure chambers that communicate with the respective first nozzles and are located above the first nozzles, the first common channel and the second common channel overlap, in the vertical direction, with each other at a position above the first pressure chambers, the first common channel overlaps, in the vertical direction, with the first pressure chambers, and the second common channel does not overlap, in the vertical direction, with the first pressure chambers.

2. The liquid ejection head according to claim 1, wherein the first common channel communicates with inlets of the first individual channels, the second common channel communicates with outlets of the first individual channels, and the second common channel has a channel area that is smaller than a channel area of the first common channel.

3. The liquid ejection head according to claim 1, further comprising a damper chamber located between the first common channel and the second common channel in the vertical direction, the damper chamber including a first damper film that partially defines the first common channel and a second damper film that partially defines the second common channel.

4. The liquid ejection head according to claim 3, wherein the damper chamber communicates with an atmosphere at respective ends thereof in the first direction.

5. The liquid ejection head according to claim 3, wherein the first damper film is longer in a second direction that is perpendicular to both of the first direction and the vertical direction, than the second damper film, and the first damper film has a Young's modulus that is greater than a Young's modulus of the second damper film.

6. The liquid ejection head according to claim 1, wherein the first common channel is shorter in the first direction than the second common channel, and is longer in a second direction that is perpendicular to both of the first direction and the vertical direction, than the second common channel, the first common channel has an upper surface having a first opening formed therein, the second common channel has an upper surface having a second opening formed therein at a position not overlapping with the first common channel.

7. The liquid ejection head according to claim 1, wherein one of the first common channel and the second common channel is longer, in a second direction that is perpendicular to both of the first direction and the vertical direction, than the other one of the first common channel and the second common channel, and is shorter in the vertical direction than the other one of the first common channel and the second common channel.

8. The liquid ejection head according to claim 1, further comprising:

a first extension channel extending downward from the first common channel; and a first communication channel that brings the first extension channel and the one of the first pressure chambers into communication with each other, wherein the first extension channel and the first communication channel do not overlap, in the vertical direction, with the one of the first pressure chambers.

9. The liquid ejection head according to claim 1, further comprising:

a second extension channel extending downward from the second common channel; and a second communication channel that brings the second extension channel and the one of the first pressure chambers into communication with each other, wherein the second extension channel and the second communication channel do not overlap, in the vertical direction, with the one of the first pressure chambers.

10. The liquid ejection head according to claim 9, further comprising:

a pressure chamber substrate having the first pressure chambers formed therein;

an actuator substrate disposed at an upper surface of the pressure chamber substrate, the actuator substrate including a plurality of actuators that overlap, in the vertical direction, with the respective first pressure chambers; and a protection substrate disposed at an upper surface of the actuator substrate, the protection substrate having a recess in which the actuators are located, wherein a distance in the vertical direction between the second communication channel and the one of the first nozzles is shorter than a distance in the vertical direction between the second communication channel and the actuator substrate.

11. The liquid ejection head according to claim 10, further comprising a nozzle plate having the first nozzles in correspondence with the respective first individual channels, wherein the nozzle plate defines portions of the second extension channel and the second communication channel.

12. The liquid ejection head according to claim 1, further comprising:

a plurality of second individual channels arranged in the first direction, adjacent to the first individual channels in a second direction perpendicular to both of the first direction and the vertical direction, wherein each of the first common channel and the second common channel communicates with the second individual channels, each of the second individual channels includes one of second nozzles, and one of second pressure chambers that communicate with the respective second nozzles and are located above the second nozzles, the first common channel and the second common channel are located above the second pressure chambers, the first common channel overlaps, in the vertical direction, with the second pressure chambers, and the second common channel does not overlap, in the vertical direction, with the second pressure chambers.

13. The liquid ejection head according to claim 12, further comprising:

a pressure chamber substrate having the first pressure chambers and the second pressure chambers formed therein;

an actuator substrate disposed at an upper surface of the pressure chamber substrate, the actuator substrate including a plurality of actuators which overlap, in the vertical direction, with the respective first pressure chambers and the second pressure chambers;

a protection substrate disposed at an upper surface of the actuator substrate, the protection substrate including:

a recess in which the actuators are located;

a portion of a first extension channel extending downward from the first common channel, the portion disposed between a respective one of the first pressure chambers and the first common channel, the portion at least partially constituting a respective one of the first individual channels; and a portion of a third extension channel extending downward from the first common channel, the portion disposed between a respective one of the second pressure chambers and the first common channel, the portion at least partially constituting a respective one of the second individual channels.

14. The liquid ejection head according to claim 12, further comprising:

a pressure chamber substrate having the first pressure chambers and the second pressure chambers formed therein;

an actuator substrate disposed at an upper surface of the pressure chamber substrate, the actuator substrate including a plurality of actuators that overlap, in the vertical direction, with the respective first pressure chambers and the second pressure chambers; and a protection substrate disposed at an upper surface of the actuator substrate, the protection substrate including:

a recess in which the actuators are located;

a portion of a second extension channel extending downward from the second common channel, the portion disposed between a respective one of the first pressure chambers and a respective one of the second pressure chambers in the second direction, the portion at least partially constituting a respective one of the first individual channels; and a portion of a fourth extension channel extending downward from the second common channel, the portion disposed between the respective one of the first pressure chambers and the respective one of the second pressure chambers in the second direction, the portion at least partially constituting a respective one of the second individual channels.

15. The liquid ejection head according to claim 14, further comprising:

a drive circuit configured to electrically connect to the actuators and supply drive signals to the actuators, the drive circuit being located at a portion of the upper surface of the actuator substrate between the second extension channel and the fourth extension channel in the second direction; and a plurality of wirings that connect the respective actuators to the drive circuit, the wirings extending in the second direction from the respective actuators toward the drive circuit, through a position between two portions of the second extension channel or a position between two portions of the fourth extension channel.

* * * * *